US009970719B2

(12) United States Patent
Bean, Jr. et al.

(10) Patent No.: US 9,970,719 B2
(45) Date of Patent: May 15, 2018

(54) WATER COLLECTION SYSTEM FOR INDIRECT EVAPORATIVE COOLER

(71) Applicant: SCHNEIDER ELECTRIC IT CORPORATION, West Kingston, RI (US)

(72) Inventors: John H. Bean, Jr., Defiance, MO (US); Roy L. Grantham, O'Fallon, MO (US); Ozan Tutunoglu, O'Fallon, MO (US)

(73) Assignee: SCHNEIDER ELECTRIC IT CORPORATION, West Kingston, RI (US)

( * ) Notice: Subject to any disclaimer, the term of this patent is extended or adjusted under 35 U.S.C. 154(b) by 0 days. days.

(21) Appl. No.: 15/123,152

(22) PCT Filed: Mar. 13, 2014

(86) PCT No.: PCT/US2014/026565
§ 371 (c)(1),
(2) Date: Sep. 1, 2016

(87) PCT Pub. No.: WO2015/137956
PCT Pub. Date: Sep. 17, 2015

(65) Prior Publication Data

US 2017/0067703 A1 Mar. 9, 2017

(51) Int. Cl.
*F28D 5/02* (2006.01)
*F28F 25/04* (2006.01)
(Continued)

(52) U.S. Cl.
CPC ..... *F28F 25/04* (2013.01); *F28B 9/08* (2013.01); *F28D 5/02* (2013.01); *F28F 25/082* (2013.01); *F28F 2025/005* (2013.01)

(58) Field of Classification Search
CPC .... F28F 25/04; F28F 25/082; F28F 2025/005; F28D 5/02; Y10S 261/85; Y10S 261/11; F28B 9/08
See application file for complete search history.

(56) References Cited

U.S. PATENT DOCUMENTS 2,318,621 A * 5/1943 O'Brien ..... F25B 37/00 165/115
2,606,750 A * 8/1952 Jacir ..... F28C 1/02 261/108
(Continued)

FOREIGN PATENT DOCUMENTS

CN 1532466 A 9/2004
CN 101330960 A 12/2008
CN 102341655 A 2/2012

OTHER PUBLICATIONS

Notification of Transmittal of the International Search Report and the Written Opinion of the International Searching Authority from corresponding PCT/US2014/026565 dated Jul. 21, 2014.
(Continued)

*Primary Examiner* — Tho V Duong
(74) *Attorney, Agent, or Firm* — Lando & Anastasi, LLP

(57) ABSTRACT

A water collection system is provided for an indirect evaporative cooler. The water collection system includes a housing having an open bottom, a front wall, a back wall, and two end walls, which together define an interior region of the housing. The water collection system further includes a plurality of tube assemblies each extending through one of the front wall and the back wall of the housing and disposed within the interior region of the housing. The water collection system further includes a plurality of panel assemblies disposed within the interior region of the housing above the plurality of tube assemblies. Each panel assembly is associated with a respective tube assembly to channel fluid to the
(Continued)

tube assembly. A method of collecting and distributing water within an indirect evaporative cooler configured to spray water on a heat exchanger is further disclosed.

13 Claims, 8 Drawing Sheets

(51) Int. Cl.

| | |
|---|---|
| ***F28F 25/08*** | (2006.01) |
| ***F28B 9/08*** | (2006.01) |
| *F28F 25/00* | (2006.01) |

(56) References Cited

U.S. PATENT DOCUMENTS 4,459,244 A * 7/1984 Norback ..... B01J 19/32 261/112.2
4,521,350 A * 6/1985 Lefevre ..... F28F 25/04 261/111
5,464,573 A * 11/1995 Tokerud ..... B01D 3/008 261/97
5,487,531 A 1/1996 Curtis
5,958,306 A * 9/1999 Curtis ..... F28F 25/02 261/112.2
8,585,024 B2 * 11/2013 Ferree ..... F28C 1/02 261/109
9,033,318 B2 5/2015 Curtis
2011/0049733 A1 3/2011 Ferree et al.

OTHER PUBLICATIONS

Extended European Search Report from corresponding European Application No. 14885745.1 dated Dec. 1, 2017.

* cited by examiner

WATER COLLECTION SYSTEM FOR INDIRECT EVAPORATIVE COOLER

CROSS-REFERENCE TO RELATED APPLICATIONS

This application is a U.S. National Stage Application under 35 U.S.C. § 371 of International Application No. PCT/US2014/026565, filed Mar. 13, 2014, titled WATER COLLECTION SYSTEM FOR INDIRECT EVAPORATIVE COOLER, which is hereby incorporated herein by reference in its entirety.

BACKGROUND OF DISCLOSURE

1. Field of Disclosure

The present disclosure relates generally to indirect evaporator cooler systems, and more particularly to a water collection system for an indirect evaporative cooler configured to spray water on a heat exchanger of the indirect evaporative cooler.

2. Discussion of Related Art

Indirect air evaporative cooling systems typically use outdoor air to indirectly cool data center air when the outside temperature is lower than the temperature set point of the IT inlet air, which can result in significant energy savings. Such systems use fans to blow cold outside air across an air-to-air heat exchanger, which in turn cools the hot data center air on the inside of the heat exchanger, thereby completely isolating the data center air from the outside air. This heat removal method normally uses an evaporative assist, in which the outside of the air-to-air heat exchanger is sprayed with water, which further lowers the temperature of the outside air and thus the hot data center air. Indirect air evaporative cooling systems can provide cooling capacities up to about 1,000 kilowatts (kW). Most units are roughly the size of a shipping container or larger. These systems mount either on a building roof or along a perimeter of the building.

Using fresh air directly to cool a data center is often viewed as the most efficient cooling approach. For data centers experiencing a wide range of temperature and humidity conditions, this cooling approach is often the most efficient. However, the majority of data center managers are risk-averse to higher temperatures and rapid changes in temperature and humidity. With rising densities and the adoption of containment practices, it is undesirable to allow IT equipment to run at higher temperatures, especially if a failure event occurs. When temperature and humidity thresholds are kept within industry-recommended limits, indirect air economizers actually provide greater efficiency than direct fresh air.

With modern indirect evaporative cooling systems, hot IT air is pulled into a cooling module, and one of two modes of economizer operation is used to eject the heat. Based on the load, the IT set point, and outdoor environmental conditions, the system automatically selects the most efficient mode of operation. The indirect air-to-air economization mode uses an air-to-air heat exchanger to transfer the heat energy from the hotter data center air to the colder outdoor air. When evaporative cooling is used, water is sprayed over the heat exchanger to reduce the surface temperature of the exchanger. By spraying water on the heat exchanger, the air temperature is reduced close to the wet bulb temperature of the outdoor air. This mode of operation allows the data center to continue to benefit from economizer mode operation, even when the air-to-air heat exchanger alone is unable to reject the data center heat load.

In one known system, a water collection system of the indirect evaporative cooler includes a matrix of troughs having four or more rows and twenty or more columns is provided for collecting water that is sprayed within an indirect evaporative cooler on the heat exchangers. Each trough is installed individually and sealed, thereby creating a very high piece count and high labor burden to manage complexity. Additionally, since the matrix of troughs is typically a welded assembly that requires a higher skill set for assembly.

SUMMARY OF DISCLOSURE

One aspect of the present disclosure is directed to a water collection system for an indirect evaporative cooler. In one embodiment, the water collection system comprises a housing having an open bottom, a front wall, a back wall, and two end walls, which together define an interior region of the housing, a plurality of tube assemblies each extending through one of the front wall and the back wall of the housing and disposed within the interior region of the housing, and a plurality of panel assemblies disposed within the interior region of the housing above the plurality of tube assemblies, each panel assembly being associated with a respective tube assembly to channel fluid to the tube assembly.

Embodiments of the water collection system further may include providing each tube assembly with an extrusion body having one end sealed in such a way as to prevent the tube assembly from passing completely through the back wall of the housing. Each panel assembly may include two molded panels adhered to on opposite sides of a flat center panel. A series of holes and posts may be arranged on each molded panel such that the molded are self locating with respect to the center panel. Each molded panel may be molded with a pattern of funnels such that the funnels are alternately staggered vertically. Each funnel may include an inlet provided at a top of the funnel and an outlet provided at a bottom of the outlet. The inlet may be rectangular and has an area greater than an area of the outlet. The outlets of the funnels may be aligned to interface with a respective drain tube assembly. Each molded panel may be assembled to each side of the center panel, with the rectangular inlet of a long funnel being opposite to the rectangular inlet of a short funnel along a length of the panel. When the panel assemblies are installed into housing, the rectangular inlets of the funnels may be staggered vertically and horizontally in a checkerboard pattern. Two corners of the rectangular opening of each funnel may be chamfered such that when the panel assemblies are disposed in the housing, the chamfered corners align to provide an overlap of funnel opening areas. The housing may include a row of openings formed in the front wall and a row of openings formed in the rear wall to locate the plurality of tube assemblies. The housing further may include a front flashing member and a back flashing member to divert water toward one of the plurality of panel assemblies. Each flashing member may include a plurality of notches formed therein to allow the panel assemblies to intersect the flashing member to locate upper corners of the panel assemblies and to secure the panel assemblies from lateral or vertical movement.

Another aspect of the disclosure is directed to a method of collecting and distributing water within an indirect evaporative cooler configured to spray water on a heat exchanger. In one embodiment, the method comprises: channeling water with a plurality of panel assemblies disposed within an interior of a housing; depositing water from the panel assemblies to a plurality of tube assemblies positioned below the panel assemblies within the housing; and collecting water from the plurality of tube assemblies to be redistributed within the indirect evaporative cooler.

Embodiments of the method further may include providing each panel assembly with two molded panels adhered to on opposite sides of a flat center panel, each molded panel including a pattern of funnels, the method further comprising staggering the funnels vertically with respect to one another. The method further may include aligning outlets of the funnels to interface with a respective drain tube assembly. The method further may include assembling the two molded panels to respective sides of the center panel, with a rectangular inlet of a long funnel being opposite to a rectangular inlet of a short funnel along a length of the panel. The method further may include installing the panel assemblies into housing, the rectangular inlets of the funnels being staggered vertically and horizontally in a checkerboard pattern. The method further may include locating the plurality of tube assemblies within a row of openings formed in the front wall and a row of openings formed in the rear wall.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 2:
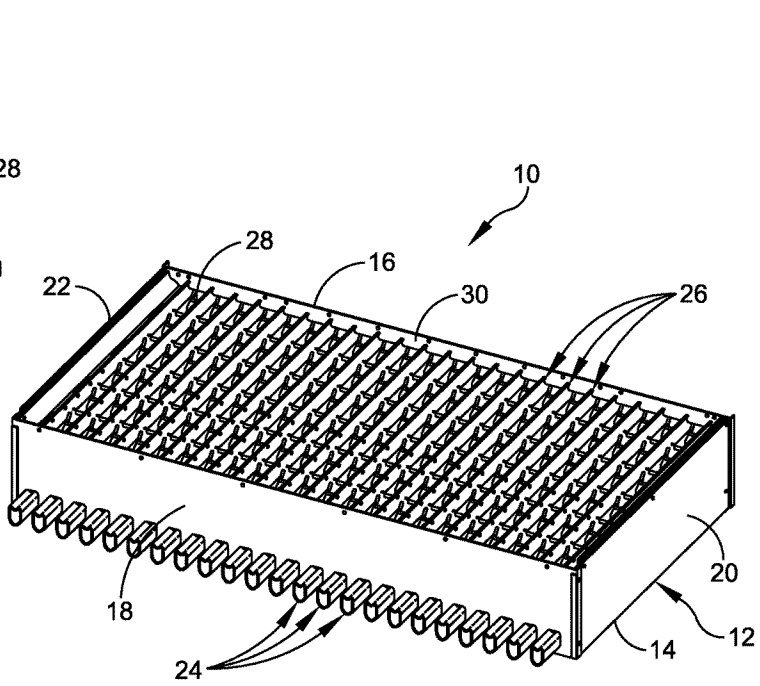
FIG. 2 is a back perspective view of the water collection system.

This disclosure is not limited in its application to the details of construction and the arrangement of components set forth in the following description or illustrated in the drawings. The principles set forth in this disclosure are capable of being provided in other embodiments and of being practiced or of being carried out in various ways. Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

Many alternative cooling approaches have been developed and adopted over the last few years in an effort provide efficient heat removal from data centers. One such method that has gained recent favor is indirect evaporative cooling. This method minimizes/eliminates the need for energy intensive mechanical refrigeration. One challenge of indirect evaporative cooling is fabrication of the evaporative cooling cell and its associated water collection system. Current state of the art uses a high number of piece parts and significant assembly labor.

In one embodiment of the present disclosure, indirect evaporative cooling cells may include a plurality of thermally adjacent airflow channels. These channels are combined in parallel in such a manner as to provide two airflow paths. One path is provided for the conveyance of fluid to be cooled, e.g., heated air from the data center IT load. The other path is provided for the conveyance of the cooling fluid, i.e., ambient outdoor air enhanced by evaporation of flowing water over channel surface. Typically, water evaporation rate is only a fraction of the total water flow rate over the channel surface. This makes it necessary to collect water not evaporated for reuse as opposed to a less favorable once through design. A water collection system must impose minimal airflow resistance of the cooling fluid, i.e., ambient outdoor air, while offering near one hundred percent effective recovery of water that has not evaporated.

The water collection system of embodiments of the present disclosure reduces the piece part count by two-thirds, while reducing weight by twenty-five percent as compared to current state of the art water collectors having an array of individual troughs arranged in multiple rows of laterally offset columns. The improvements of the system of the present disclosure are the result of an arrangement of rectangular topped funnels disposed in a checkerboard pattern in two planes vertically offset from one another allowing easy passage of airflow but covering the entire the cross sectional area perpendicular to the flowing water.

Figure 1:
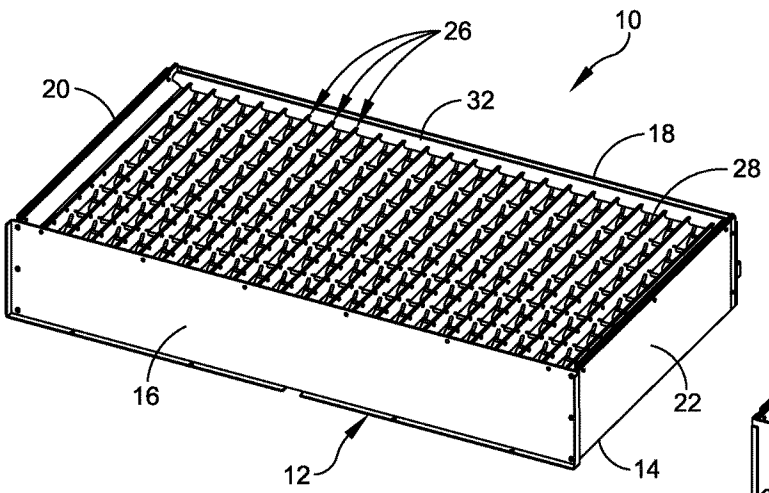
FIG. 1 is a front perspective view of a water collection system of an embodiment of the present disclosure.

Referring now to the drawings, and more particularly to FIGS. 1 and 2, a water collection system of embodiments of the present disclosure is generally indicated at 10. The water collection system 10 is configured to be located within an indirect evaporative cooler or similar cooling unit. Specifically, the water collection system is configured to collect water that is sprayed by a spray assembly onto a heat exchanger located above the water collection system within the indirect evaporative cooler. The water collection system also may be provided to collect and manage rain that drops from the heat exchanger during operation. As shown, the water collection system 10 includes a housing, generally indicated at 12, that supports the components of the water collection system. In the shown embodiment, the housing 12 includes an open bottom 14, a front wall 16, a back wall 18, and two end walls 20, 22, which together define an interior region of the housing that supports the components of the water collection system 10. It should be understood that the housing 12 may be sized and shaped as required to suit the form factor of the particular cooler in which the water collection system 10 is installed. In one embodiment, the housing 12 is fabricated by riveting or welding panels of steel. However, any suitable materials may be utilized.

The water collection system 10 further includes a several tube assemblies, each generally indicated at 24, which extend through the back wall 18 of the housing 12 and are disposed within the interior region of the housing. The water collection system further includes several of panel assemblies, each generally indicated at 26, which are disposed within the interior region of the housing 12 above the tube assemblies 24. As shown, each panel assembly 26 is associated with a respective tube assembly 24 and positioned directly above its respective tube assembly. Moreover, as shown, the panel assemblies 26 extend crosswise with respect to a length of the housing 12. However, the panel assemblies 26 may be configured to extend lengthwise with respect to the length of the housing 12.

Figure 3:
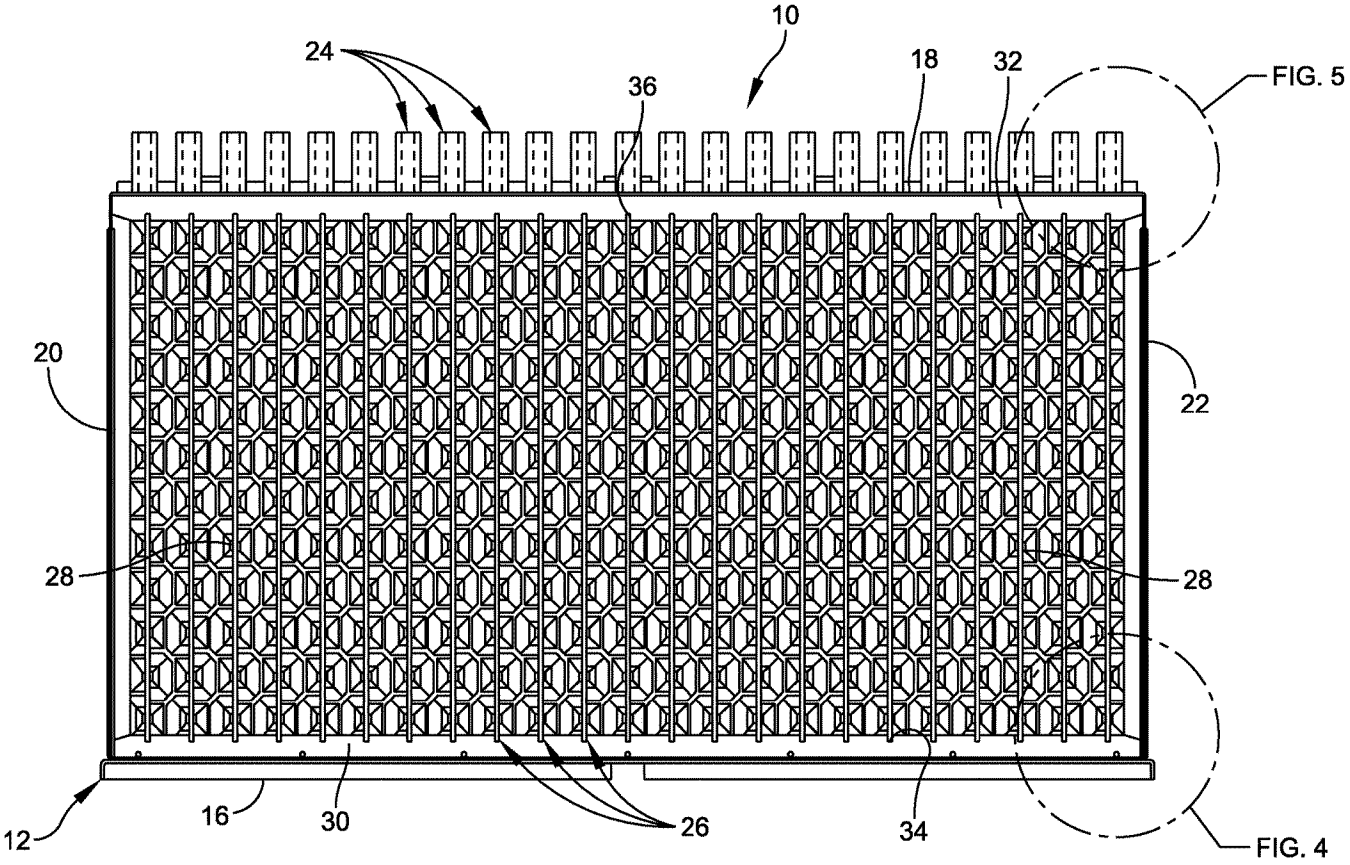
FIG. 3 is a top plan view of the water collection system.

Referring to FIG. 3, each panel assembly 26 includes a centerline 28 that is disposed directly above its respective tube assembly 24 so that the panel assembly extends along an axis that is disposed directly above and parallel to an axis of the tube assembly. In the shown embodiment, there are twenty-three tube assemblies 24 and twenty-three panel assemblies 26; however, any number of tube and panel assemblies may be provided depending on the size of the housing 12 or the sizes of the tube assemblies and panel assemblies of the water collection system 10.

Figure 5:
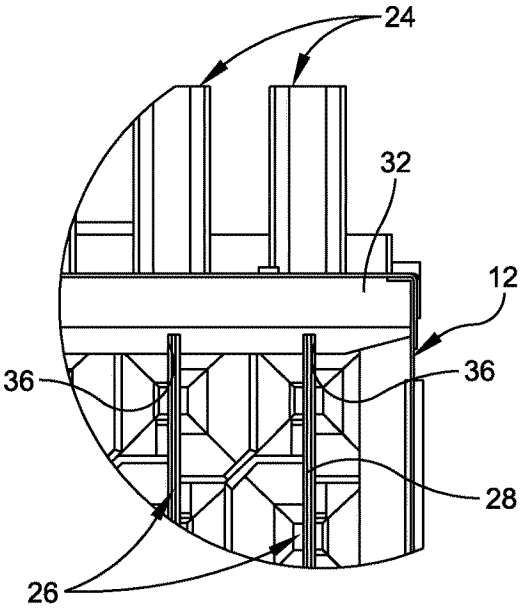
FIG. 5 is an enlarged view of another portion of the water collection system shown in FIG. 3.
Figure 4:
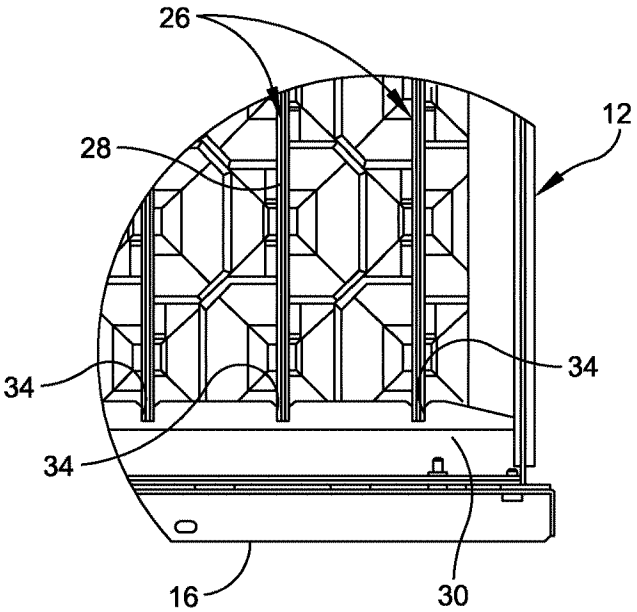
FIG. 4 is an enlarged view of a portion of the water collection system shown in FIG. 3.

The housing 12 of the water collection system 10 further includes a front flashing member 30 and a back flashing member 32 to divert water toward one of the plurality of panel assemblies 26 disposed in the housing 12. As shown, the front flashing member 30 is secured to the front wall 16 along a top edge of the front wall. Similarly, the back flashing member 32 is secured to the back wall 18 along a top edge of the back wall. Each flashing member 30, 32 includes respective notches 34, 36 formed in the flashing member to allow respective panel assemblies 26 to intersect the flashing member to more securely position the panel assemblies within the housing 12. The notches 34, 36 are provided to locate upper corners of the panel assemblies 26 and to secure the panel assemblies to prevent lateral or vertical movement. The flashing members 30, 32 can be assembled to the front and back walls 16, 18, respectively of the housing 12 with rivets, screws and/or by welding. FIGS. 4 and 5 illustrate the manner in which the flashing members 30, 32 can be secured to the housing 12 as well as the notches 34, 36 provided in the respective flashing members. As shown, the flashing members 30, 32 are secured to their respective front and back walls 16, 18 by screws.

Figure 6:
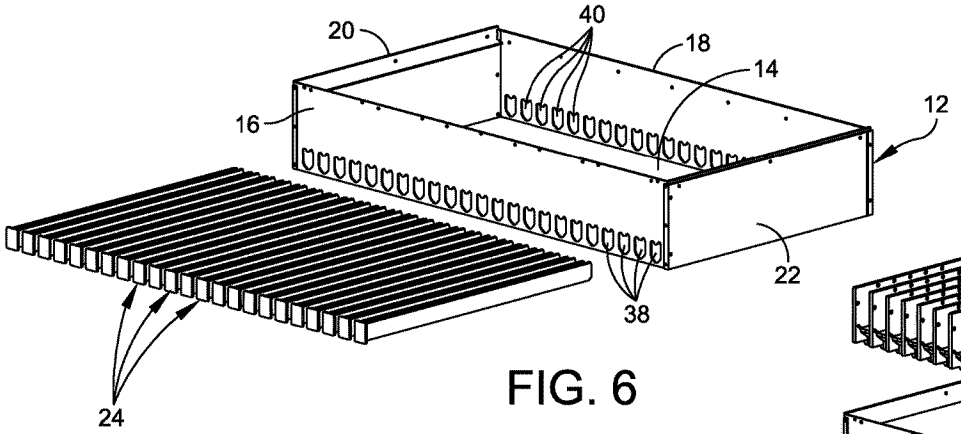
FIGS. 6-8 are perspective views showing the assembly of component parts of the water collection system.
Figure 7:
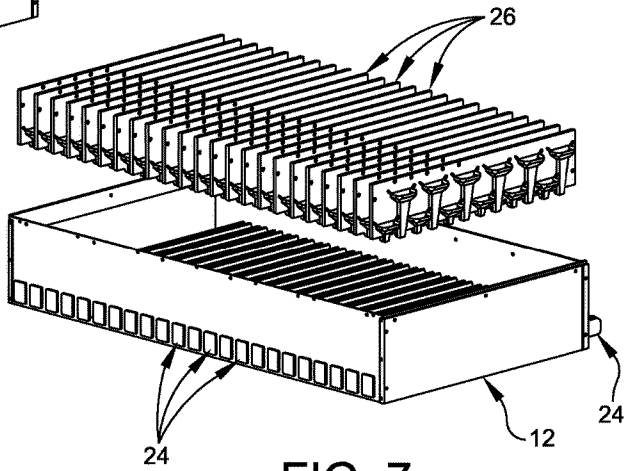
Figure 8:
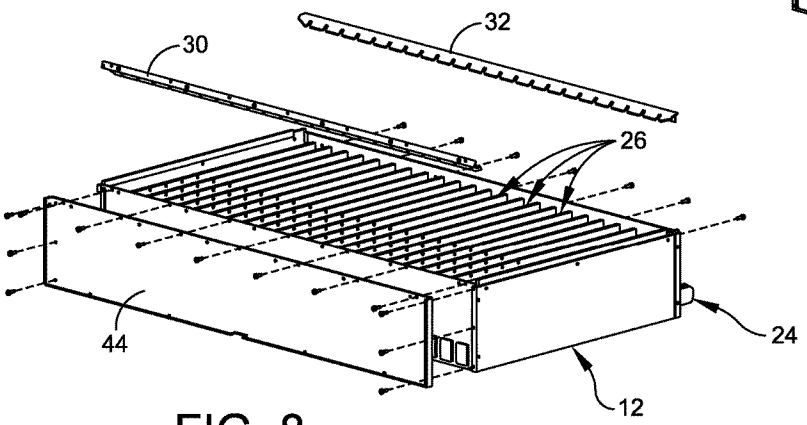

Referring to FIGS. 6-8, the manner in which the water collection system 10 is assembled is illustrated sequentially in these drawings. FIG. 6 illustrates the tube assemblies 24 prior to their insertion into a row of openings, each indicated at 38, formed in the front wall 16, and into similar row of openings, each indicated at 40, formed in the back wall 18 of the housing 12. The openings 38 of the front wall 16 and the openings of the back wall 18 are aligned with each other to position the tube assemblies 24 within the housing 12 at a bottom of the interior of the housing. As shown, each tube assembly 24 is received within a respective opening 38 of the front wall 16 and a respective opening of the back wall 18 so that an end of the tube assembly is flush with the front wall and an opposite end of the tube assembly extends through the back wall. As will be shown and described in greater detail below, each tube assembly 24 includes an extrusion body having one end sealed in such a way as to prevent fluid from flowing out of the end of the extrusion body. The other end of the extrusion body is configured to drain in a suitable trough or other collection device to direct the fluid back to the spray assembly of the evaporative cooler. The construction of the tube assembly 24 will be described in greater detail below with reference to FIGS. 13 and 14.

FIG. 7 illustrates the insertion of the panel assemblies 26 of the water collection system 10 into the interior of the housing 12 above the tube assemblies 24. As shown, the panel assemblies 26 are positioned above their respective tube assemblies 24 and held in place by the front wall 16, back wall 18 and end walls 20, 22 of the housing 12. In other embodiments, the panel assemblies 26 can be held in place with suitable fasteners to the respective walls of the housing 12.

FIG. 8 illustrates a front panel 44 attached to the front of the housing 12 to create the front wall 16 with suitable fasteners, such as screw fasteners. The front panel 44 creates a neat, clean appearance, and covers the sealed ends of the tube assemblies 24. As mentioned above, the flashing members 30, 32 are also secured to the housing 12 by suitable fasteners, such as screw fasteners. The ends of the panel assemblies are held in place by the notches 34, 36 formed in the front and back flashing members 30, 32, respectively.

Figure 11:
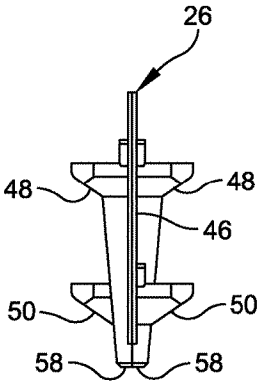
FIG. 11 is an end view of the funnel panel assembly.
Figure 9:
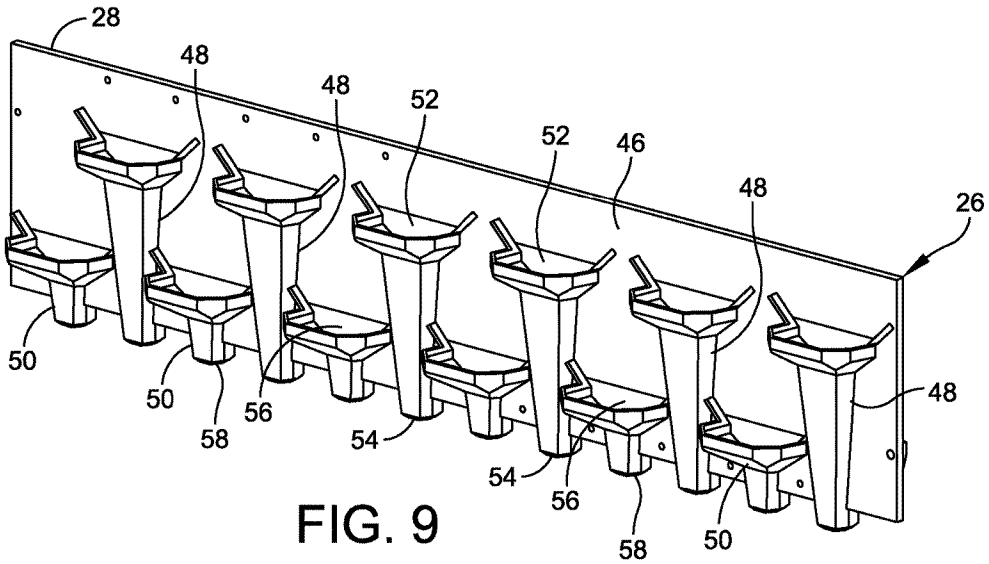
FIG. 9 is a perspective view of a funnel panel assembly of the water collection system.
Figure 10:
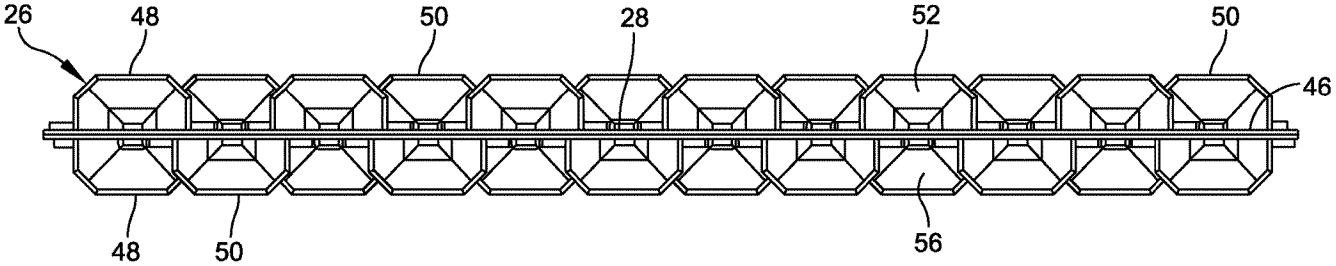
FIG. 10 is a top plan view of the funnel panel assembly.

Referring to FIGS. 9-11, the assembled panel assembly 26 will be shown and described. Each panel assembly 26 includes an elongate, planar body 46 having a plurality of funnels 48, 50 positioned on both sides of the planar body. As shown, the funnels 48, 50 are configured in a pattern such that the funnels are alternately staggered vertically along a length of the planar body 46. Specifically, the funnels 48, 50 are formed along the sides of the planar body 46 such that "long" funnels 48 and "short" funnels 50 alternate along the length of the side of the planar body. Each long funnel 48 includes an inlet 52 provided at a top of the funnel and an outlet 54 provided at a bottom of the funnel. Similarly, each short funnel 50 includes an inlet 56 provided at a top of the funnel and an outlet 58 provided at a bottom of the funnel. In one embodiment, each inlet 52, 56 is rectangular in construction and has an area greater than an area of its respective outlet 54, 58. The outlets 54, 58 of the funnels 48, 50, respectively, are aligned to interface with a respective drain tube assembly 24.

Figure 12:
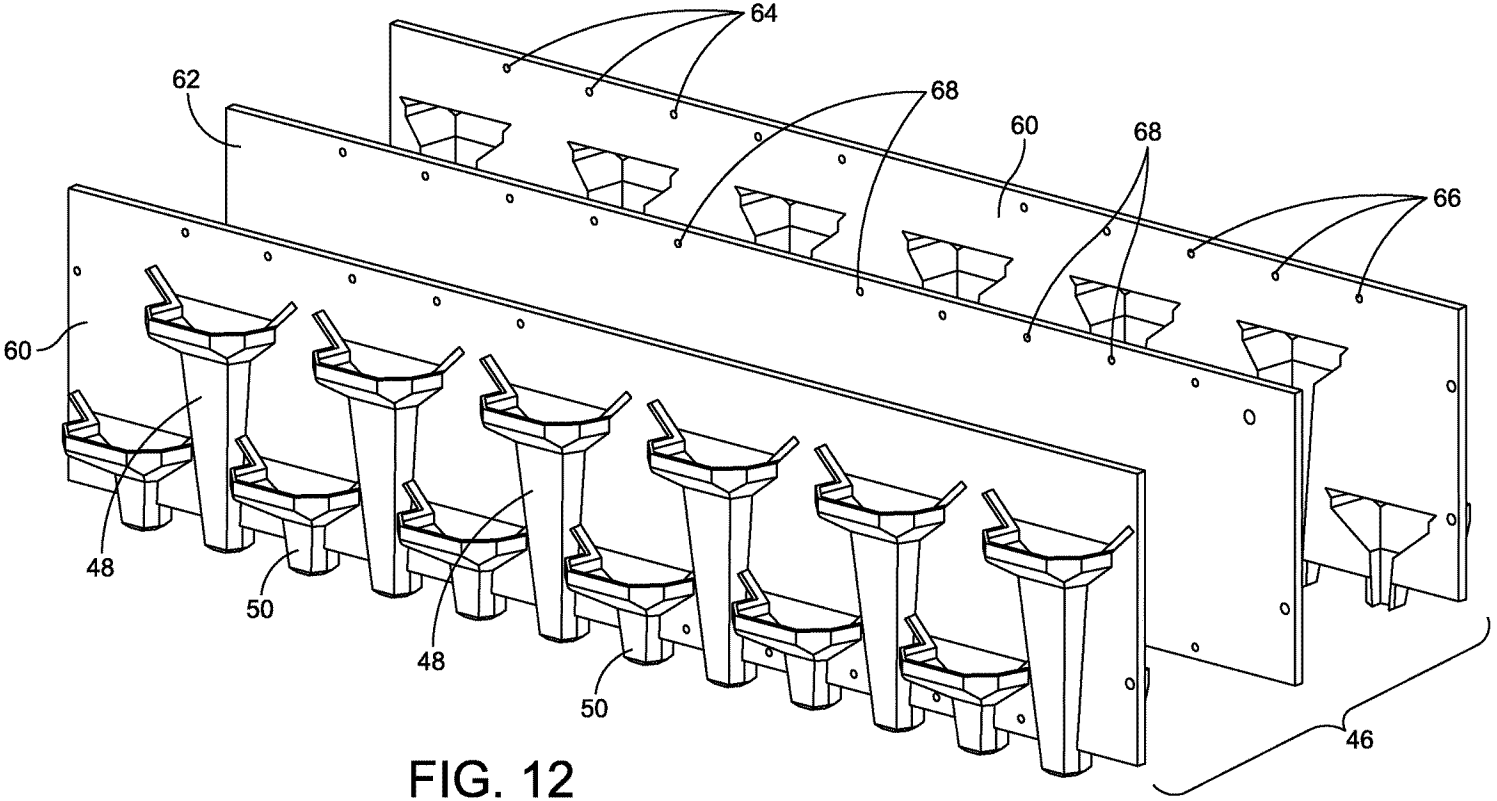
FIG. 12 is an exploded perspective view of the funnel panel assembly.

Referring to FIG. 12, the planar body 46 and the funnels 48, 50 of each panel assembly 26 is fabricated from two molded panels, each indicated at 60, adhered to on opposite sides of a flat center panel 62. As shown, each molded panel 60 includes the funnels 48, 50 formed thereon, a series of posts, each indicated at 64, which project from a side of the molded panel opposite the funnels, and a series of openings, each indicated at 66, which are formed in the molded panel and aligned to receive the posts from the other molded panel therein. The posts 64 are formed on one end of the side of the molded panel 60 and the openings 66 are formed on the other end of the side of the panel. The arrangement is such that the molded panel 60 is reversible so that the molded panels can embody both sides of the planar body 46. In one embodiment, the panels 60, 62 are assembled with a suitable adhesive or epoxy material.

The center panel includes a series of openings 68 formed therein, which are located to receive the posts 64 from the molded panels 60 therein. The arrangement is such that the molded panels 60 are self locating with respect to the center panel 62. The two molded panels 60 are assembled to the sides the center panel 62, with the rectangular inlet 52 of a long funnel 48 being opposite to the rectangular inlet 56 of a short funnel 50 along a length of the panel assembly 26. The panel assemblies 26 are installed into housing 12, with the rectangular inlets 52, 56 of the funnels 48, 50, respectively, being staggered vertically and horizontally in a checkerboard pattern. In a certain embodiment, for each rectangular inlet 52, 56, two corners of the rectangular inlets are chamfered such that when the panel assemblies 25 are disposed in the housing, the chamfered corners are aligned to provide an overlap of funnel opening areas. The molded panels 60 can be formed through an injection mold process from any suitable synthetic material. The center panel 62 can be molded, but also fabricated from a flat sheet with the holes formed therein punched or drilled.

Figure 13:
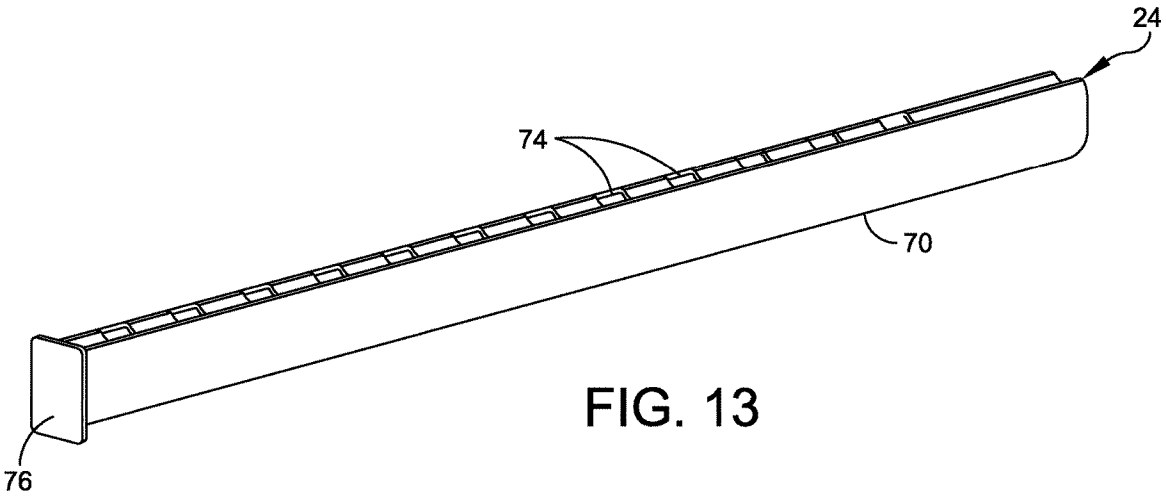
FIG. 13 is a perspective view of a tube assembly of the water collection system.
Figure 14:
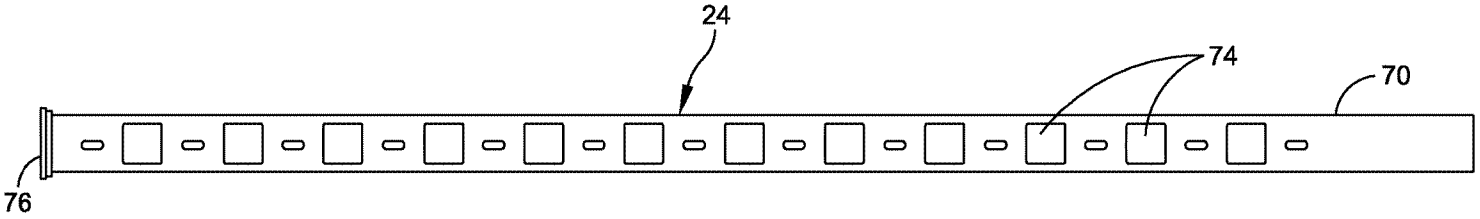
FIG. 14 is a top plan view of the tube assembly.

FIGS. 13 and 14 illustrate the manner in which the tube assembly 24 of the water collection system 10 is assembled. As shown, the tube assembly 24 includes a body 70 having a top wall 72 with a plurality of openings, each indicated at 74, formed along a length of the body. The openings 74 are positioned to correspond to the locations of the outlets 54, 58 of the funnels 48, 50 of the panel assembly 26 disposed above the tube assembly 24. The arrangement is such that the funnel outlets 54, 58 are aligned with the openings 74 to receive water that is deposited within the inlets 52, 56 of the funnels 48, 50, respectively, of the water collection system 10. There are also smaller slots formed on either side of each opening 74, which allow water that travels down the panel walls to enter the tube assembly. Each tube assembly 24 includes a rectangular end cap 76 to close one end of the body 70 of the tube assembly. The body 70 can be extruded from synthetic or other suitable material, while the end cap 76 can be formed through an injection mold process from synthetic material. In one embodiment, the end cap 76 is secured to the body 70 by a suitable adhesive or epoxy material.

Figure 15:
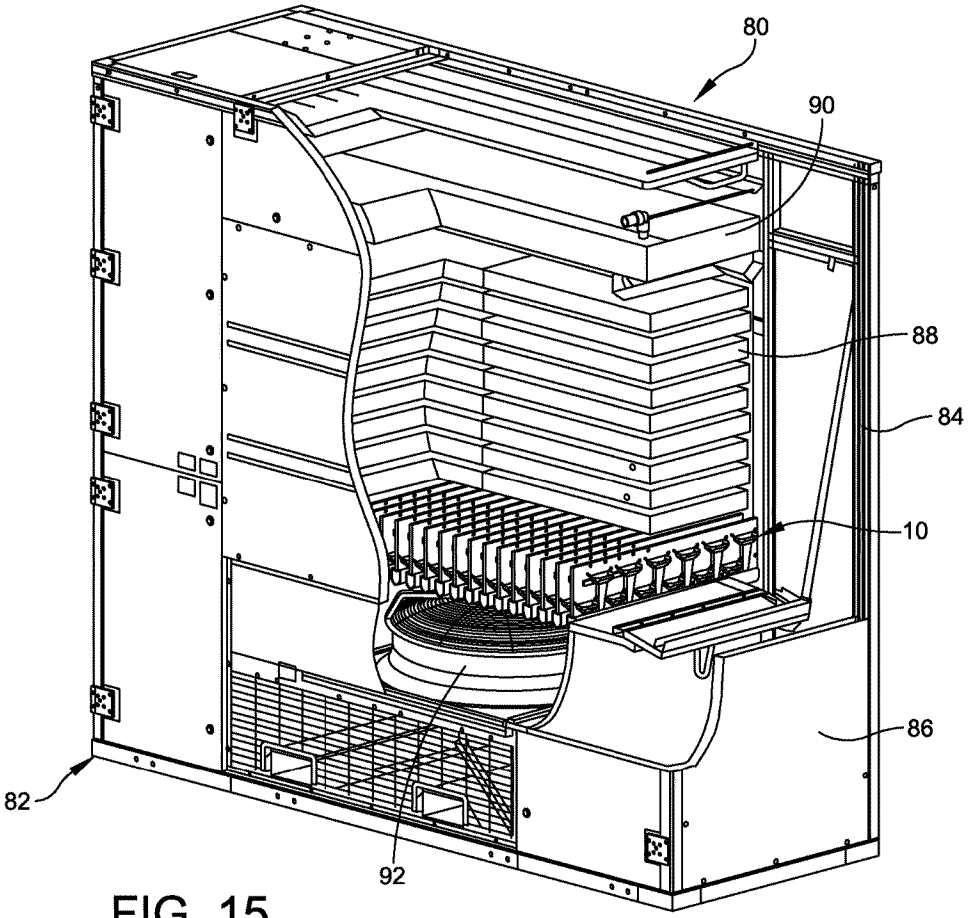
FIG. 15 is a perspective view of an indirect evaporative cooler having a portion of a housing removed with the water collection system.

Referring to FIG. 15, in one embodiment, the water collection system 10 is provided within an indirect evaporative cooler, generally indicated at 80. One or more of these cooling modules may be arranged together to form a large cooling system. As shown, the indirect evaporative cooler 80 includes a housing, generally indicated at 82, which in the shown embodiment is a box-like structure having an internal frame 84 and removable panels, each indicated 86, which are used to enclose the interior of the housing. The indirect evaporative cooler 80 further includes a heat exchanger 88 supported within the interior of the housing 82 and a spray assembly 90 disposed above the heat exchanger and configured to spray water over the heat exchanger. The water collection system 10 is positioned below the heat exchanger 88 and provided to collect and recycle the water that is sprayed over the heat exchanger. As shown, all of the tube assemblies 24 protrude out from the back wall 18 of the housing 12 and empty into a central trough configured to collect the water for the cooling system. During operation, water is sprayed on the heat exchanger 88 by the spray assembly 90 to provide further cooling to the heat exchanger. The water that is sprayed on the heat exchanger 88 drips into the trough of the water collection system 10, which is configured to cool the heated water more efficiently prior to being re-circulated or redistributed back the spray assembly 90. The water collection system 10 is designed to sufficiently cover the entire surface area of the heat exchanger 88 so that all of the water sprayed on the heat exchanger is collected. A large fan is positioned below the water collection system 10 to direct the outside air through the water collection system, through the heat exchanger 88, and through the top of the indirect evaporative cooler 80.

As shown and described, the water collection system of embodiments of the present disclosure reduces the number and complexity of parts used in the system, improves water capture performance, includes fewer simpler drain points, lowers airflow pressure, and avoids excessive welding.

As shown, the checkerboard pattern of the funnels creates a continuous surface across the plane. However, by vertically offsetting the funnels, the surface of the water collection system provides continuous coverage of cross sectional area along a top surface of the system.

In one embodiment, the water collector assembly includes a welded sheet metal housing, with a row of openings in the front and rear walls that locate a series of drain tubes. The welded housing also incorporates flashing to divert water toward the first funnel panels located on each side. The flashing can be assembled to the housing with rivets, screws and/or welding. Each drain tube is an extrusion with one end capped off (sealed) in such a way as to prevent the tube from passing completely through the housing front wall. A single funnel panel assembly is then placed into the housing onto each drain tube. The funnel panel assemblies includes a molded panel (a single part) adhered to both sides of a flat center panel. There are a series of holes and posts arranged on the funnel panel such that the funnel panels are self locating to the center panel, which incorporates a hole pattern that accepts the posts from each funnel panel. Ideally, the panel assembly is assembled with an adhesive instead of fasteners for ease of manufacturing.

The funnel panels are molded with the a pattern of funnels such that the funnels are alternately staggered vertically, or such that the rectangular openings of the funnels are alternately staggered vertically, but that the funnel outlets are all aligned to interface with a single drain tube. When one funnel panel is assembled to each side the center panel, the rectangular funnel opening of the "long" funnel will be opposite of the rectangular opening of the "short" funnel in every location along the panel. Thus, when the funnel panels are installed into the water collector housing, all of the funnel openings are staggered vertically and horizontally, as in a three-dimensional "checkerboard" pattern. Additionally, each of the two corners of the rectangular openings of the funnels are chamfered such that when the panels are assembled into the water collector, the chamfered corners align to provide an overlap of the funnel opening areas when viewing from above.

The front and rear flashing includes a notch for allowing each funnel panel assembly to intersect the flashing, thereby locating the upper corners of the panels and securing the panels from lateral or vertical movement. The front and rear flashing can be assembled to the housing with rivets and/or screws.

A front panel is assembled to the front of the housing with screws and/or rivets to secure the drain tubes from sliding back out of the housing. Gaskets are then applied on some surfaces to seal those areas of the water collector inside the module.

In one embodiment, the offset between planes creating an air passage in an upward direction to provide cooling air source for the evaporative cooling. The funnel array(s) providing gravity water drain of collected water into common drain header.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. A water collection system for an indirect evaporative cooler, the water collection system comprising:

a housing having a front wall, a back wall, and two end walls, which together define an interior region of the housing;

a plurality of tube assemblies each extending through one of the front wall and the back wall of the housing and disposed within the interior region of the housing; and a plurality of panel assemblies disposed within the interior region of the housing above the plurality of tube assemblies, each panel assembly being associated with a respective tube assembly to channel fluid to the tube assembly, each panel assembly including two molded panels adhered to on opposite sides of a flat center panel.

2. The water collection system of claim 1, wherein each tube assembly includes an extrusion body having one end sealed in such a way as to prevent the tube assembly from passing completely through the back wall of the housing.

3. The water collection system of claim 1, wherein a series of holes and posts arranged on each molded panel such that the molded are self locating with respect to the center panel.

4. The water collection system of claim 1, wherein each molded panel is molded with a pattern of funnels such that the funnels are alternately staggered vertically.

5. The water collection system of claim 4, wherein each funnel includes an inlet provided at a top of the funnel and an outlet provided at a bottom of the outlet.

6. The water collection system of claim 5, wherein the inlet is rectangular and has an area greater than an area of the outlet.

7. The water collection system of claim 6, wherein the outlets of the funnels are aligned to interface with a respective drain tube assembly.

8. The water collection system of claim 6, wherein each molded panel is assembled to each side of the center panel, with the rectangular inlet of a long funnel being opposite to the rectangular inlet of a short funnel along a length of the panel.

9. The water collection system of claim 8, wherein when the panel assemblies are installed into housing, the rectangular inlets of the funnels are staggered vertically and horizontally in a checkerboard pattern.

10. The water collection system of claim 6, wherein two corners of the rectangular opening of each funnel is chamfered such that when the panel assemblies are disposed in the housing, the chamfered corners align to provide an overlap of funnel opening areas.

11. The water collection system of claim 1, wherein the housing includes a row of openings formed in the front wall and a row of openings formed in the rear wall to locate the plurality of tube assemblies.

12. The water collection system of claim 1, wherein the housing further includes a front flashing member and a back flashing member to divert water toward one of the plurality of panel assemblies.

13. The water collection system of claim 12, wherein each flashing member includes a plurality of notches formed therein to allow the panel assemblies to intersect the flashing member to locate upper corners of the panel assemblies and to secure the panel assemblies from lateral or vertical movement.

* * * * *